United States Patent [19]

Satoma

[11] Patent Number: 4,690,079

[45] Date of Patent: Sep. 1, 1987

[54] OVEREDGE WIDTH REGULATING DEVICE FOR OVEREDGING SEWING MACHINES

[75] Inventor: Shiro Satoma, Chofu, Japan

[73] Assignee: Tokyo Juki Industrial Co., Ltd., Chofu, Japan

[21] Appl. No.: 945,664

[22] Filed: Dec. 23, 1986

[30] Foreign Application Priority Data

Dec. 28, 1985 [JP] Japan ..... 60-298667

[51] Int. Cl.[4] ..... D05B 1/20

[52] U.S. Cl. ..... 112/162; 112/126; 112/315

[58] Field of Search ..... 112/122, 126, 162, 177, 112/314, 315

[56] References Cited

U.S. PATENT DOCUMENTS 3,009,430 11/1961 Lutz et al. ..... 112/162

4,205,616 6/1980 Sugahara ..... 112/162 X 4,570,558 2/1986 Hirayama et al. ..... 112/162

FOREIGN PATENT DOCUMENTS 59-67169 5/1984 Japan .

*Primary Examiner*—H. Hampton Hunter

*Attorney, Agent, or Firm*—Morgan & Finnegan

[57] ABSTRACT

There is disclosed an overedge width regulating device capable of adjusting overedge width by rotating a knob which causes both a overedge-width latch and a lower knife to move simultaneously. The device permits adjustment of the overedge-width latch independently from the lower knife and the release of the overedge-width latch during the roll hemming process. Thus, without regard to material being sewn, knitted or woven, a tight and well-balanced overedge finish is obtained while, at the same time, the overedging process is greatly improved from the viewpoint of both quality and time.

2 Claims, 7 Drawing Figures

OVEREDGE WIDTH REGULATING DEVICE FOR OVEREDGING SEWING MACHINES

BACKGROUND OF THE INVENTION

This invention relates to an overedge width regulating device for overedging sewing machines.

Conventionally, it is often necessary when using overedging sewing machines to take into account the material and the number of overlayed fabrics of the workpiece to determine the overedge width to meet the requirements of the particular application. To adjust the overedge width, the operator ordinarily has to change the throat plate for one which has a suitable overedge-width latch.

Where a sewing machine is equipped with a throat plate which has an adjustable overedge-width latch, an operator has to manually adjust the overedge width by moving the overedge-width latch back and forth, or left and right, and then has to adjust the position of the lower knife to meet with the adjusted overedge width. To do so, an operator typically has to open a cover sheet located under the table supporting the sewing machine to expose the lower knife. Such operations are very troublesome.

Further, adjustments of the lower knife are generally accomplished by loosening and tightening screws which fix the knife to the machine. Consequently, such manipulations not only require the operator's expertise, but, as well, considerable loss of time is expected.

For the purpose of overcoming the above-mentioned disadvantages, Japanese Laid Open Utility Model Application No. 59-67169 discloses a device for regulating the overedge width by adjusting both the overadge-width latch and the lower knife simultaneously.

Referring more specifically to FIG. 5 herein, keypoints of the Japanese Laid Open Application will now be explained. In FIG. 5, numeral 21 denotes a throat plate and numeral 22 denotes a throat-plate pin which is extended from the throat plate 21 in the direction of feeding (arrow "A"). Numeral 23 denotes an overedge-width latch which is set in parallel with the throat-plate pin 22 and its rear end is fixed to a movable piece 26 via a fixing block 24. The movable piece 26 is slidably attached to move up and down to a lower knife holder 27 which holds a lower knife 16 via a guide channel 28 and a presser plate 29. A control shaft 31 is provided with male screw threads 35 which cooperate with female screw threads 36 provided in the lower knife holder 27. Control shaft 31 is further provided with a knob 37 at its end.

By rotating only the knob 37, the lower knife holder 27 and the movable piece 26 are moved simultaneously in a direction normal to the feeding direction. Thus, the lower knife 16 and the overedge-width latch 23 move in the same direction and the overedge width is adjusted simply by rotating the knob 37 alone.

Accordingly, for a conventional type of overedging sewing machine such as that briefly described above, the purpose of one-touch adjusting of both the overedge-width latch 23 and the position of the lower knife 16 is achieved by the apparatus of FIG. 5. However, since the overedge-width latch 23 is attached to the lower knife holder 27, it is difficult to minutely adjust the relative position between the overedge-width latch 23 and the lower knife 16.

In some cases, where the workpiece material is knitted fabric, the fabric shrinks during the overedging process and the threads are not tightly overedged. Consequently, in such cases conventional overedging sewing machines do not satisfy the requirements for making such adjustments.

It is, therefore an object of the invention to provide a device which eliminates the aforementioned disadvantages of conventional overedging sewing machines and which enables simultaneous adjustment of both the overedge-width latch and the lower knife, while, at the same time, enables adjustments of the position of the overedge-width latch in relation to the position of the lower knife.

SUMMARY OF THE INVENTION

In accordance with the invention, there is provided an overedge-width regulating device comprising a movable piece which moves along a guide shaft, the movable piece being provided with a shaft hole to receive a holder-shaft of the lower-knife such that the direction of movement of the movable piece and the lower knife holder are parallel, the movable piece also being provided with a shaft hole to receive a latch shaft such that the overedge-width latch is slidably adjustable to slide along the latch shaft by loosening a screw which fixes the overedge-width latch to the latch shaft. In addition, the latch shaft is arranged so that it rotates about its center such that the overedge-width latch rotates therewith and is released from its working position when not needed.

In accordance with the above-described arrangement, as explained more fully hereinbelow, the relative position between the overedge-width latch and the lower knife is adjusted easily and accurately and, when the overedge-width latch is not needed (e.g., because a roll hemming process is required), the overedge-width latch is rotated and released.

BRIEF DESCRIPTION OF THE DRAWINGS

In order to understand the present invention more fully, reference is directed to the accompanying drawings which are to be taken in conjunction with the detailed description of the invention set forth below and in which drawings.

Figure 1A:
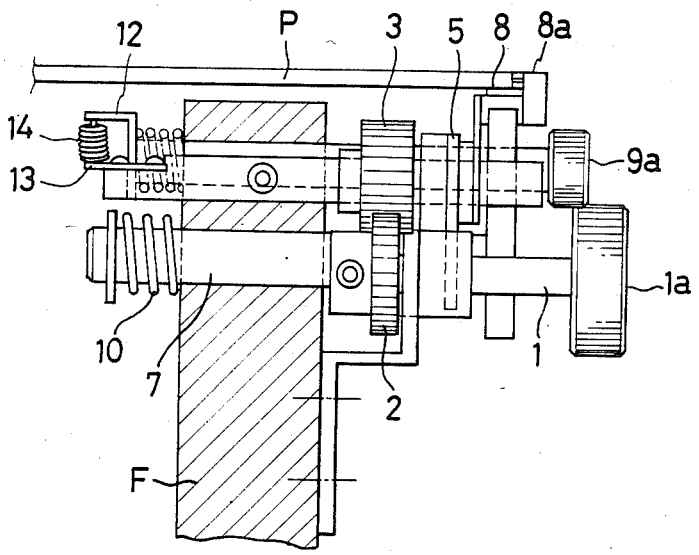
FIG. 1A is a side view of a preferred embodiment of an overedge width regulating device according to the invention.
Figure 1B:
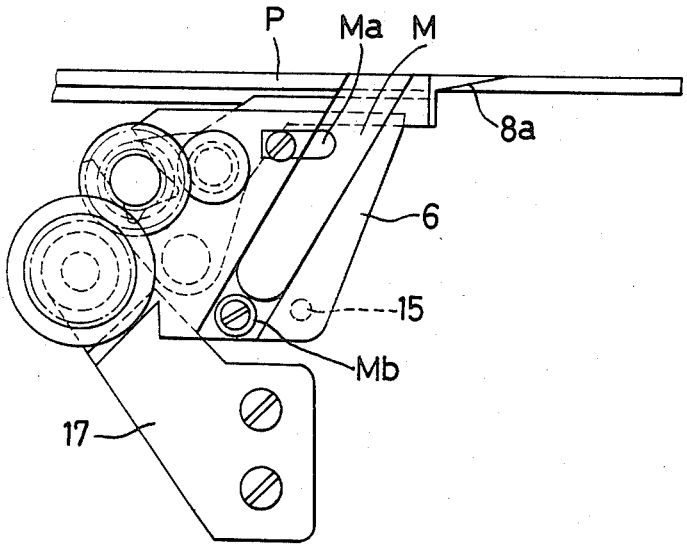
FIG. 1B is a front view of the device illustrated in FIG. 1A.
Figure 1C:
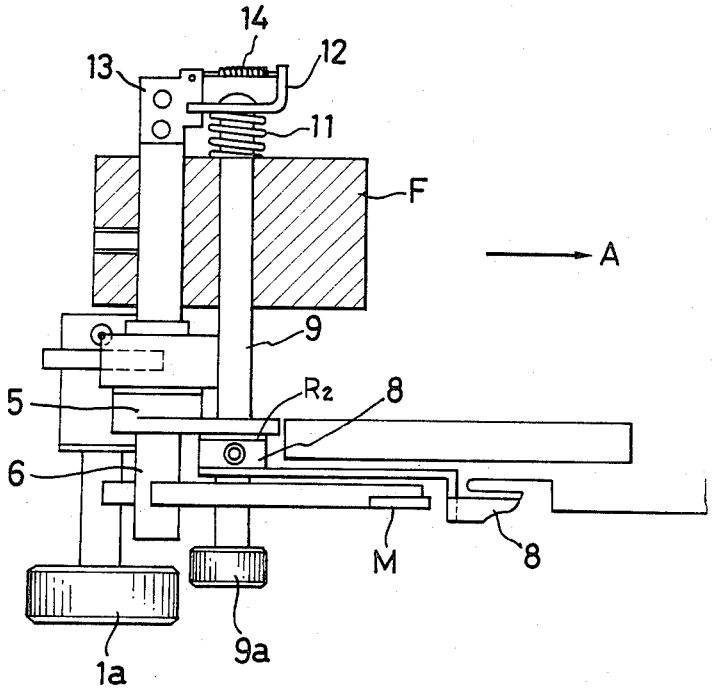
FIG. 1C is a plan view of the device illustrated in FIG. 1A.

In the drawings, P denotes a throat plate, M denotes a lower knife, numeral 8 denotes an overedge-width latch and F denotes a machine frame.

DETAILED DESCRIPTION OF THE DRAWINGS

Figure 2:
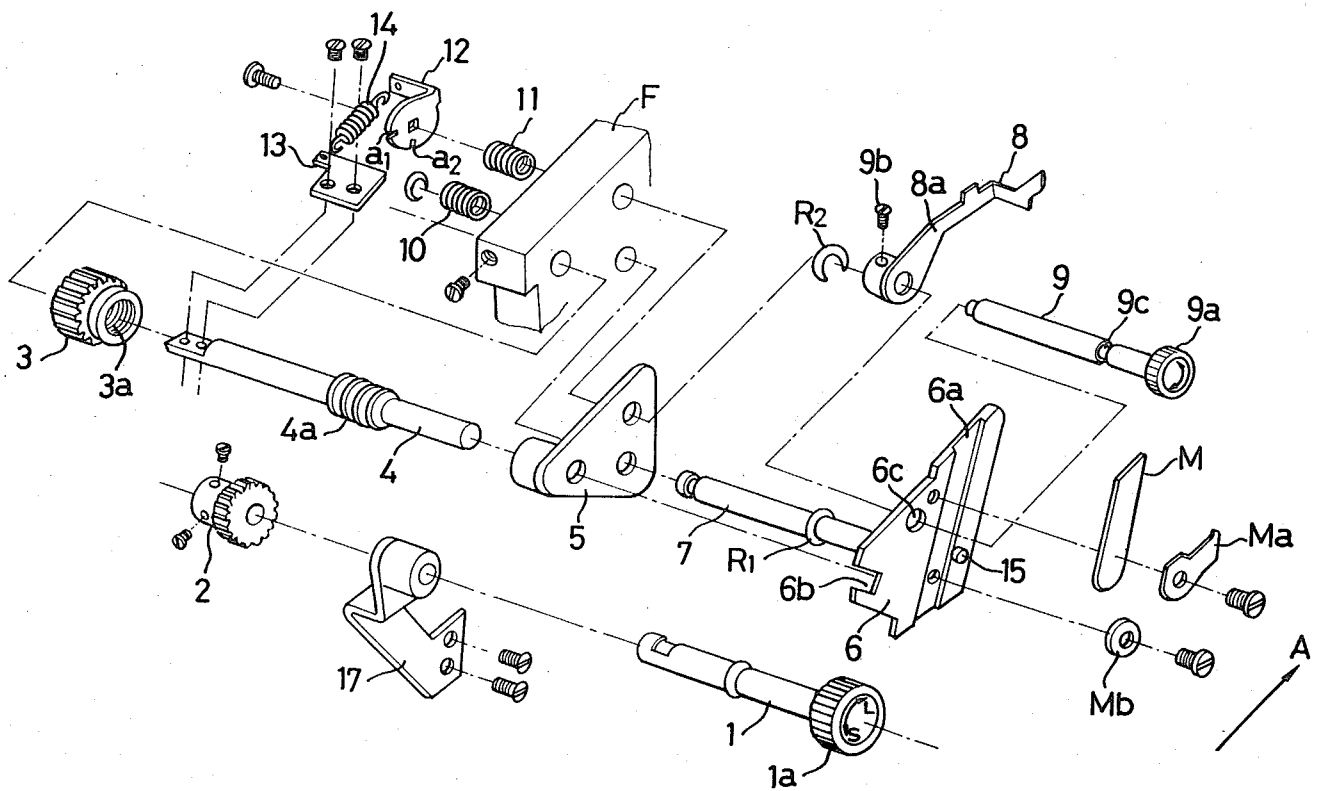
FIG. 2 is an exploded view in perspective of the device illustrated in FIG. 1A.
Figure 3:
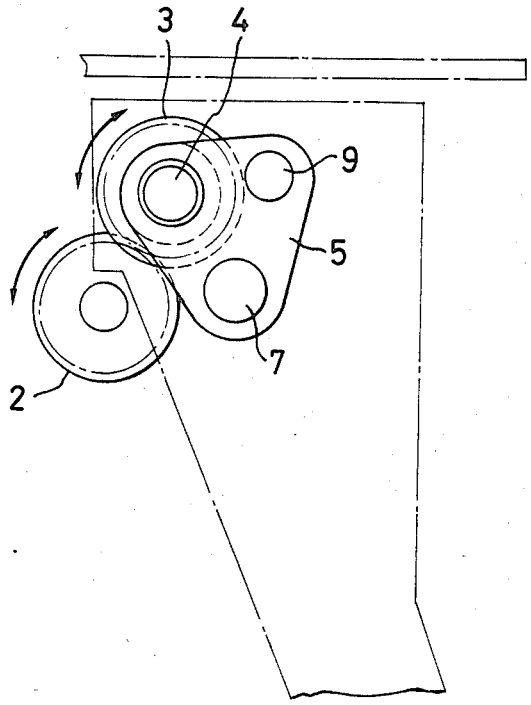
FIG. 3 is a partial view in detail of the device shown in FIG. 1B illustrating the position of the gear wheels.

Referring now more particularly to FIG. 2, three holes are pierced through machine frame F in parallel.

A movable piece 5 is likewise provided with three holes which are located therein so that they are in alignment with the holes made in the frame F. Three shafts, namely, a guide shaft 4, a lower-knife-holder-shaft 7 and a latch shaft 9 are disposed in the holes of the movable piece 5 and through the three holes of frame F, respectively, so that they are in parallel disposition.

While the guide shaft 4 fixed to the frame F by a screw, the lower-knife-holder-shaft 7 slidably penetrates the frame F and the movable piece 5. While the latch shaft 9 slidably penetrates through the frame F and the movable piece 5, it also passes through holes in a latch shaft 8*a* and in a lower-knife-holder 6, as explained more fully hereinbelow.

A regulating shaft 1 is rotatably supported in a bracket 17 which is fixed to the machine frame F by screws, such that the regulating shaft is in parallel alignment with shafts 4,7 and 9. Regulating shaft 1 is provided with a knob 1*a* at one end and a gear wheel 2 at the other end, the knob 1*a* and the gear wheel 2 being fixed to the regulating shaft by screws.

At the middle portion of the guide shaft 4, male screw threads 4*a* are provided. Female screw threads 3*a* are provided inside an opening of a driven gear wheel 3 which mate with male screw threads 4*a*, and the previously mentioned gear wheel 2 fixed on the regulating shaft 1 meshes with the driven gear wheel 3. Movable piece 5 through which guide shaft 4 is slidably inserted touches the face of driven gear wheel 3.

One end of the guide shaft 4 is provided with a stopper 13 which restricts the rotation of the overedge-width latch 8. Stopper 13 is fixed to the guide shaft 4 by screws. The other end of guide shaft 4 is slidably disposed in a notch 6*b* provided on the lower-knife holder 6. Notch 6*b* prevents the end of guide shaft 4 from abutting or coming in contact with the lower-knife holder 6.

A snap ring $R_1$ is provided on the middle portion of the lower-knife-holder-shaft 7. This snap ring $R_1$ is urged into contact with the movable piece 5 by a spring 10 which acts to pull the lower-knife-holder-shaft 7 into contact with the movable piece. A lower knife M is held in place in a channel 6*a* formed in lower-knife holder 6 by a presser plate Ma, and a stopper plate Mb is in contact with the bottom end of the lower knife M. Thus, the lower knife M is held steadily. Plates Ma and Mb are fixed to the lower-knife holder 6 by screws.

The lower-knife holder 6 is provided with a hole 6*c* in which a latch shaft 9 is slidably disposed, as hereinbefore explained, and, as well, with a stopper pin 15 which stops rotation of the overedge-width latch 8. A knob 9*a* is provided at one end of latch shaft 9. Latch shaft 9 is slidably inserted through an opening in a latch supporting body 8*a*. Body 8*a* is then fixed to the latch shaft by a screw 9*b*. Thus, the relative position between the lower knife M and the overedge-width latch 8 can be adjusted by changing the position of the latch supporting body 8*a* by sliding the same along the latch shaft 9. The end of latch shaft 9 passes through hole 6*c* of lower-knife holder 6, latch supporting body 8*a*, movable piece 5, machine frame F and a spring 11, and is then fixed to a switching plate 12.

Figure 4:
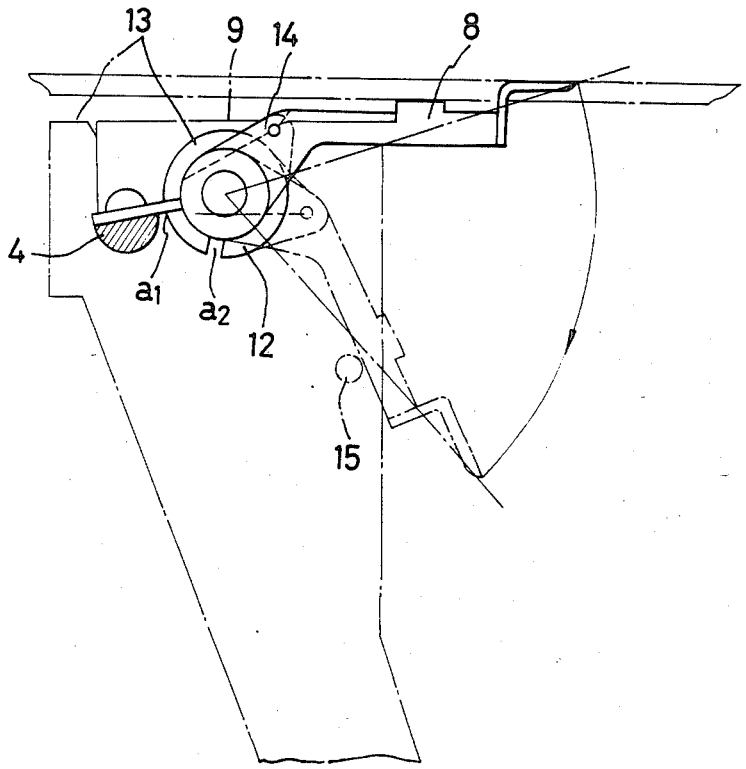
FIG. 4 is a partial view in detail of the device shown in FIG. 1B showing how an overedge-width latch is rotated for releasing.
Figure 5:
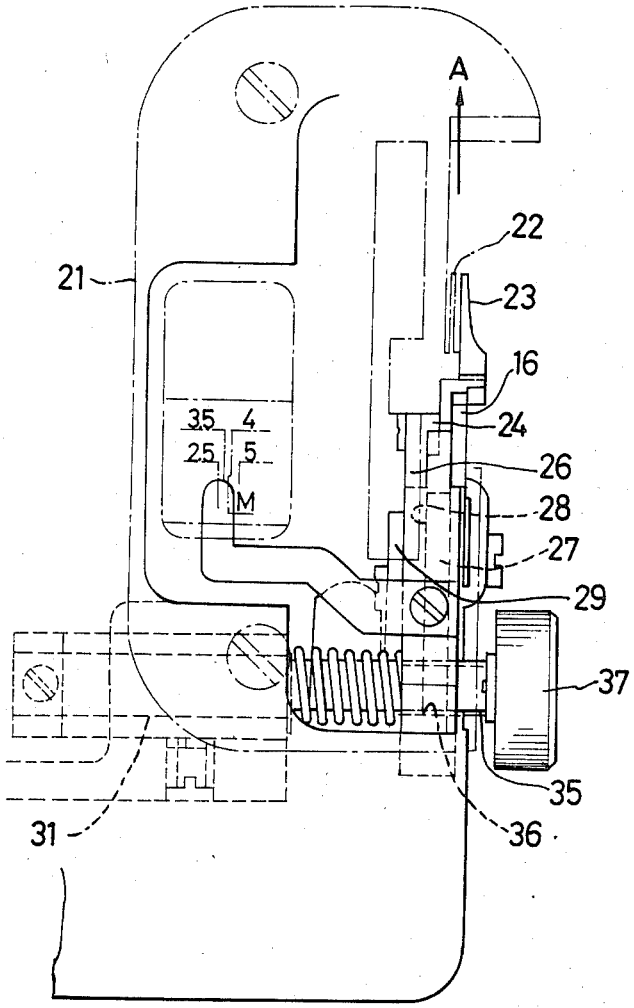
FIG. 5 PRIOR ART
FIG. 5 is an illustration of a conventional type of device for adjusting the overedge width.

Switching plate 12 is provided with notches $a_1$ and $a_2$. A switching spring 14 is stretched between the switching plate 12 and stopper 13 which is fixed to the end of the guide shaft 4. Thus, stopper 13 is engageable with either notch $a_1$ or notch $a_2$ by rotating latch shaft 9 by the knob 9*a*, as seen in FIG. 4.

Latch shaft 9 is provided with a groove 9*c* which receives a snap ring $R_2$. Snap ring $R_2$ is urged into contact with the front surface of movable piece 5 by spring 11 which acts to pull on the latch shaft 9. Since snap rings $R_1$ and $R_2$ are pressing against the front surface of the movable piece 5, as described above, the driven gear wheel 3 contacts the back surface of movable piece 5.

The device of this embodiment of the invention operates as follows:

(a) Adjusting the overedge width

Rotating the knob 1*a* in either clockwise or counter-clockwise direction causes gear wheel 2 to rotate and thus rotates driven gear wheel 3, which simultaneously moves gear wheel 3 along guide shaft 4. Driven gear wheel 3 pushes movable piece 5, since the guide shaft 4 is fixed to the machine in frame F. Since the front surface of movable piece 5 is always urged to contact with snap rings $R_1$ and $R_2$ by springs 10 and 11, rspectively, the lower knife holder 6 moves in a direction normal to feeding direction "A", and, as a result, the lower knife M and the overedge-width latch 8 also move simultaneously in that direction. Thus, the overedge width is regulated accurately by rotating knob 1*a*. Moreover, rotation of knob 1*a* can be done even during stitching.

(b) Adjusting the relative position between the overedge-width latch and the lower knife M When an operator wants to adjust the cutting (hemming) width of a workpiece independently from the overedge width, one does so simply by loosening screw 9*b* and sliding latch 8 along the latch shaft 9. Thus, the relative position between latch 9 and lower knife M can be adjusted to avoid a loosened overedging finish and to improve the overedging finish.

(c) Releasing the latch (for roll hemming)

When a roll hemming process (very narrow overedging) is required, the overedge-width latch 8 should be released. To do so, knob 1*a* is simply further rotated clockwise from the maximum overedge width position. Then, the latch shaft 9 moves further in the direction of knob 9*a*, and finally notch $a_1$ provided in the switching plate 12 disengages from stopper 13.

Next, knob 9*a* is rotated clockwise until the overedge-width latch 8 is stopped by stopper pin 15 provided on the lower knife holder 6, as shown in FIG. 4. Then, knob 1*a* on the regulating shaft 1 is rotated counter-clockwise slightly, and, as a result, notch $a_2$ engages with stopper 13. Thus, the overegde-width latch 8 is released and kept stationery at the lower position as shown in FIG. 4, and the roll hemming process can be accomplished.

When the operator wants to switch from the roll hemming process to the overedging process, knob 1*a* is rotated clockwise to disengage notch $a_2$ from stopper 13 and then knob 9*a* is rotated counter-clockwise until it is stopped by the under surface of the throat plate. Then knob 1*a* is rotated counter-clockwise and, as a result, notch $a_1$ engages stopper 13, thus returning the overedge-width latch 8 to its original position where it is retained in a stationery position for accomplishing the overedging process.

In accordance with the invention, the overedge width is regulated by only one regulating knob which causes both the overedge-width latch and the lower knife to move simultaneously, and, when the relative position between the overedge-width latch and the lower knife needs some adjustment, such adjustments are accomplished simply by moving the overedge-width latch independently from the lower knife until the desired adjustment is achieved. Moreover, the overedge-width latch is released and set back again simply and easily when switching from overedging to roll hemming and vice versa.

As many apparently widely differently embodiments of this invention may be made without departing from the spirit and scope thereof, it is to be understood that the invention is not limited to the specific embodiments described herein, but should be interpreted only in accordance with the appended claims.

What is claimed is:

1. In an overedging sewing machine capable of adjusting overedge width by moving an overedge-width latch and a lower knife, both adjacently located near the needle holes of said machine, in a direction crossing to the feeding direction of a workpiece, an overedge width regulating device comprising: a movable piece which moves along a plurality of shafts in a direction crossing the feeding direction of said workpiece; an overedge-width latch arranged on one of said plurality of shafts which is adapted to move in a direction crossing the feeding direction of said workpiece; a lower knife arranged on one of said plurality of shafts which moves simultaneously with said movable piece and in the same direction as said movable piece; a switching means located on one of said plurality of shafts for releasing and returning said overedge-width latch to its original position; and adjusting means located on one of said plurality of shafts for moving said movable piece back and forth by rotating a knob located on one of said plurality of shafts.

2. An overedge width regulating device according to claim 1, wherein the overedge-width latch is moved along a latch shaft and the relative position between said overedge-width latch and the lower knife is adjusted.

* * * * *